US007465202B2

(12) United States Patent
Takada et al.

(10) Patent No.: US 7,465,202 B2
(45) Date of Patent: Dec. 16, 2008

(54) OUTBOARD MOTOR STEERING CONTROL SYSTEM

(75) Inventors: Hideaki Takada, Saitama (JP); Shinsaku Nakayama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/655,297

(22) Filed: Jan. 19, 2007

(65) Prior Publication Data

US 2007/0197110 A1 Aug. 23, 2007

(30) Foreign Application Priority Data

Feb. 20, 2006 (JP) ..... 2006-042491

(51) Int. Cl.
*B63H 5/125* (2006.01)
*B63H 20/08* (2006.01)

(52) U.S. Cl. ..... 440/61 S

(58) Field of Classification Search ..... 440/53, 440/61 A, 61 B, 61 C, 61 G, 61 R, 61 S, 62, 440/63

See application file for complete search history.

(56) References Cited

U.S. PATENT DOCUMENTS 4,373,920 A * 2/1983 Hall et al. ..... 440/59
2006/0264129 A1* 11/2006 Mizuguchi et al. ..... 440/53

FOREIGN PATENT DOCUMENTS

JP 62-125996 6/1987
JP 2002-187597 7/2002

* cited by examiner

*Primary Examiner*—Jesús D Sotelo
*Assistant Examiner*—Daniel V Venne
(74) *Attorney, Agent, or Firm*—Carrier, Blackman & Associates, P.C.; Joseph P. Carrier; William D. Blackman

(57) ABSTRACT

An outboard motor steering control system is configured to have both an electric steering mechanism (having an electric motor, steering angle sensor and electronic controller such as microcomputer) and a hydraulic steering mechanism (having a hydraulic cylinder and a hydraulic pump) that can be switched therebetween in response to manipulation by the operator. With this, switching from one of the electric steering mechanism and hydraulic steering mechanism to the other can be easily conducted, thereby enabling to easily cope with the operator's preference of steering feel. Further, even if a failure occurs in one of the electric steering mechanism and hydraulic steering mechanism, the steering operation of the outboard motor can be continued by switching from the one steering mechanism to the other, i.e., normally-operating steering mechanism.

21 Claims, 7 Drawing Sheets

OUTBOARD MOTOR STEERING CONTROL SYSTEM

CROSS-REFERENCE TO RELATED APPLICATION

The present application claims priority under 35 USC 119 based on Japanese Patent Application No. 2006-042491, filed on Feb. 20, 2006, the entire disclosure of which is incorporated herein by reference.

BACKGROUND OF THE INVENTION

1. Field of the Invention

This invention relates to an outboard motor steering control system.

2. Description of the Related Art

Conventionally, a hydraulic steering mechanism that is equipped with a hydraulic cylinder, utilizes a helm pump to discharge or delivery hydraulic oil by the amount in response to turning of a steering wheel and supplies the discharged oil via tubes to the hydraulic cylinder, thereby enabling to steer the outboard motor with respect to the hull (boat), is well-known as a type of steering systems of outboard motors, for example, as taught by Japanese Laid-Open Patent Application No. Sho 62(1987)-125996 (particularly in FIG. 2 etc.). In such a hydraulic steering mechanism, since an outboard motor and a steering wheel are mechanically connected, the operator can feel external force acting on the outboard motor from load of the steering wheel and can experience direct steering feel. This is also the same in a manual steering mechanism which steers an outboard motor through a push-pull cable in response to the operator's turning of a steering wheel.

Aside from the above, an electric steering mechanism is recently proposed which is equipped with an electric motor that is connected to a steering shaft of the outboard motor, detects turned amount of a steering wheel and controls the operation of the electric motor based on the detected rotation angle to steer the outboard motor with respect to the hull, for example, as taught by Japanese Laid-Open Patent Application No. 2002-187597 (particularly paragraphs 0011, 0025 and 0027 and FIG. 1). Since this type of the electric steering mechanism has no mechanical connection between the outboard motor and the steering wheel, even when the steering load of the outboard motor is heavy, the burden on the operator can advantageously be lightened, thereby enabling to achieve the facilitated operating feel.

However, since an outboard motor is normally provided with either the hydraulic steering mechanism or the electric steering mechanism, when the operator is not satisfied with the steering or operating feel, he/she must replace the mechanism to another or change the outboard motor as a whole, rendering difficult to cope with the operator's preference of steering feel. Further, in the case of occurrence of a steering mechanism failure, it is difficult to continue the steering operation of the outboard motor.

SUMMARY OF THE INVENTION

An object of the invention is therefore to overcome the foregoing drawback by providing an outboard motor steering control system that easily satisfies the operator's preference of steering feel and enables to continue the steering operation of the outboard motor even when a steering mechanism failure occurs.

In order to achieve the object, the present invention provides a system for controlling steering of an outboard motor adapted to be mounted on a stern of a boat and having an internal combustion engine that powers a propeller, comprising: a steering wheel adapted to be installed at a cockpit of the boat to be turned by an operator; a steering shaft installed in the outboard motor through which the outboard motor can be steered relative to the boat; an electric steering mechanism having a steering wheel angle sensor which produces an output indicative of a turned amount of the steering wheel, a rotation angle sensor which produces an output indicative of a rotation angle of the steering shaft, an electric actuator which is adapted to rotate the outboard motor about the steering shaft, and a controller which controls operation of the electric actuator in response to the outputs of the steering wheel angle sensor and the rotation angle sensor such that the outboard motor is steered relative to the boat; a hydraulic steering mechanism having a hydraulic actuator which is adapted to rotate the outboard motor about the steering shaft and a hydraulic pump which supplies operating oil to the hydraulic actuator in response to turning of the steering wheel such that the outboard motor is steered relative to the boat; and a switch which switches steering control between the electric steering mechanism and the hydraulic steering mechanism in response to manipulation by an operator.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

An outboard motor steering control system according to preferred embodiments of the present invention will now be explained with reference to the attached drawings.

Figure 1:
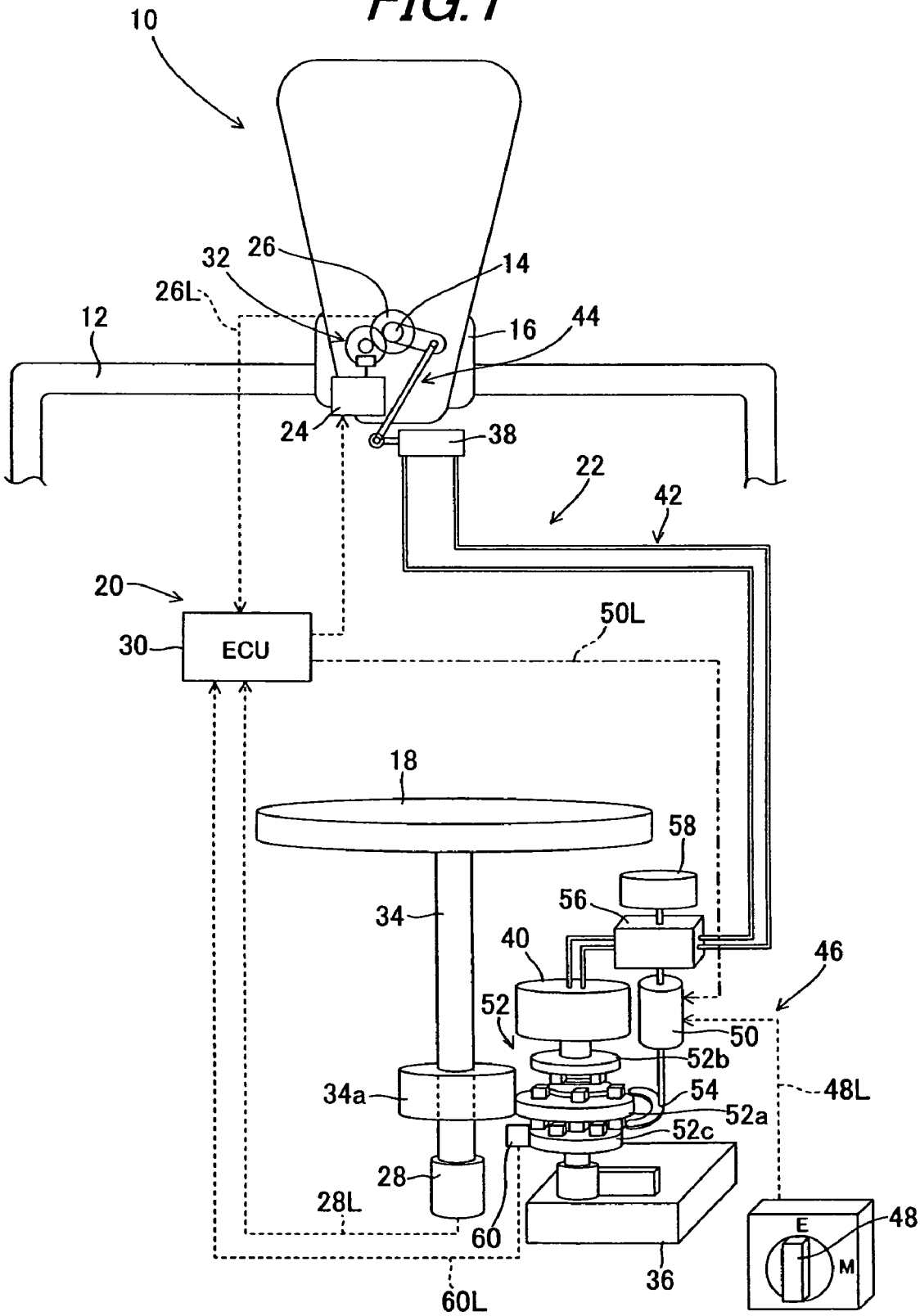
FIG. 1 is a schematic view of an outboard motor steering control system according to a first embodiment of the invention.

FIG. 1 is a schematic view of an outboard motor steering control system according to a first embodiment of the invention.

In FIG. 1, reference numeral 10 indicates an outboard motor 10. The outboard motor 10 is mounted on the stem or transom of a boat or hull 12. Although not shown, the outboard motor is adapted to be mounted on a stem of the boat 12 and has an internal combustion engine that powers a propeller. Specifically, the outboard motor 10 is fastened to the stem through stem brackets 14 to be freely moved, i.e., steered about a swivel shaft 14. A steering wheel 18 is installed near a cockpit or operator's seat of the boat 12.

In the figure, reference numeral 20 indicates an electric steering mechanism and reference numeral 22 a hydraulic steering mechanism. The outboard motor steering control system according to the first embodiment comprises both of the electric steering mechanism 20 and hydraulic steering mechanism 22 as the steering mechanism of the outboard motor.

The electric steering mechanism 20 comprises an electric motor 24, rotation angle sensor 26, steering wheel angle sensor 28 and electronic control unit (ECU) 30.

The electric motor 24 is installed in the outboard motor 10 and its rotational output is transmitted to the swivel shaft (steering shaft) 14 through a gear mechanism 32. Specifically, rotation of the swivel shaft 14 generated by the motor 24 moves the outboard motor 10 to steer it relative to the boat 12.

As shown in FIG. 1, the rotation angle sensor 26 installed on the periphery of the swivel shaft 14 produces an output or signal indicative of rotating angle of the swivel shaft 14, i.e., the steering angle of the outboard motor 10 relative to the boat 12. The output of the rotation angle sensor 26 is sent to the ECU 30 via a signal line 26L. The steering wheel angle sensor 28 is installed near a rotation shaft 34 connected to the steering wheel 18 and produces an output or signal indicative of turned amount (rotated angle) of the steering wheel 18 manipulated by the operator. The output of the steering wheel angle sensor 28 is also sent to the ECU 30 via a signal line 28L.

The ECU 30 determines a desired steering angle of the outboard motor 10 based on the output of the steering wheel angle sensor 28 and controls the operation of the motor 24 such that the steering angle detected by the rotation angel sensor 26 becomes equal to the determined desired steering angle. The ECU 30 is disposed in the outboard motor 10.

A steering load generator 36 is provided near the rotation shaft 34 of the steering wheel 18. The steering load generator 36 is composed of a known hydraulic damper mechanism and generates load to the operator's turning manipulation of the steering wheel 18. Since the electric steering mechanism 20 has no mechanical connection between the outboard motor 10 and the steering wheel 18, the steering load generator 36 is provided to eliminate uncomfortable feel of the operator caused by the turning manipulation of the steering wheel 18 with no load. Details of the steering load generator 36 are described in Japanese Laid-Open Patent Application No. 2005-313823 proposed by the applicant earlier and the further explanation is omitted.

The hydraulic steering mechanism 22 comprises a hydraulic cylinder 38, helm pump (hydraulic pump) 40 and hydraulic circuit 42.

As shown in FIG. 1, the hydraulic cylinder 38 is installed at the boat 12 and its reciprocating movement is transmitted to the swivel shaft 14 through a link mechanism 44. Specifically, the cylinder 38 makes the swivel shaft 14 rotate to steer the outboard motor 10 relative to the boat 12. The helm pump (hydraulic pump) 40 discharges or conveys operating oil by the amount in accordance with the turned amount of the steering wheel 18 into an oil path of the hydraulic circuit 42. The discharged oil is supplied via the hydraulic circuit 42 to the cylinder 38 to make it reciprocate. The cylinder 38 is composed of a double-acting hydraulic cylinder.

In FIG. 1, reference numeral 46 indicates a switching mechanism (switch) that switches the mechanism between the electric steering mechanism 20 and hydraulic steering mechanism 22. The switching mechanism 46 switches from the electric steering mechanism 20 to the hydraulic steering mechanism 22, and vice versa. The switching mechanism 46 is installed near the rotation shaft 34 of the steering wheel 18.

The switching mechanism 46 comprises a tab switch 48, electromagnetic solenoid 50 and clutch 52. The tab switch 48 is disposed near the steering wheel 18 to be freely manipulated by the operator and connected to the solenoid 50 via a signal line 48L. The tab switch 48 has two positions, i.e., an M position for energizing the solenoid 50 and an E position for de-energizing it and is manipulated to switch from one of the two positions to the other.

As shown in the figure, the clutch 52 is composed of three dog plates accumulated one above the other. A first dog plate 52*a* located middle of the three is disk-shaped and formed at each of its upper and lower surfaces with a plurality of dog teeth and at its circumferential surface with gear teeth (not shown) to be engaged with a gear 34*a* integrally rotating with the rotation shaft 34 of the steering wheel 18 to be freely rotated therewith, and is freely moved or slid vertically while keeping engagement with the gear 34*a*. The teeth width of the gear 34*a* of the steering wheel rotation shaft 34 in the direction of the shaft is appropriately determined in accordance with an amount of vertical movement of the first dog plate 52*a*.

A second dog plate 52*b* having dog teeth to be engaged with the dog teeth at the upper surface of the first dog plate 52*a* is rotatably installed above the first dog plate 52*a*. The second dog plate 52*b* is connected to the helm pump 40. A third dog plate 52*c* having dog teeth to be engaged with the dog teeth at the lower surface of the first dog plate 52*a* is rotatably installed below the first dog plate 52*a*. The third dog plate 52*c* is connected to the steering load generator 36.

The first dog plate 52*a* is connected to the electromagnetic solenoid 50 through a clutch shifter 54. When the tab switch 48 is manipulated to the M position by the operator to energize the solenoid 50, the solenoid 50 drives through the clutch shifter 54 the first dog plate 52*a* to move upward, thereby establishing engagement of the first dog plate 52*a* with the second dog plate 52*b*. On the other hand, when the tab switch 48 is manipulated to the E position by the operator to de-energize the solenoid 50, the solenoid 50 drives through the clutch shifter 54 the first dog plate 52*a* to move downward, thereby establishing engagement of the first dog plate 52*a* with the third dog plate 52*c*.

Specifically, the clutch 52 is driven in response to the manipulation of the tab switch 48 by the operator to transmit turning of the steering wheel 18 to one of the helm pump 40 and steering load generator 36. In other words, the clutch 52 is freely manipulated by the operator to make or release the connection between the rotation shaft 34 and helm pump 40.

The solenoid 50 is installed at its upper portion with an oil-path opening/closing mechanism 56 for opening and closing the oil path of the hydraulic circuit 42. In case that the connection between the rotation shaft 34 of the steering wheel 18 and the helm pump 40 is cut off, the operation of the helm pump 40 is prevented despite turning of the steering wheel 18 and, hence, the operating oil is not discharged. The oil-path opening/closing mechanism 56 is provided to ensure to prevent the operating oil from being discharged even if the helm pump 40 may operate due to a certain reason.

Figure 2:
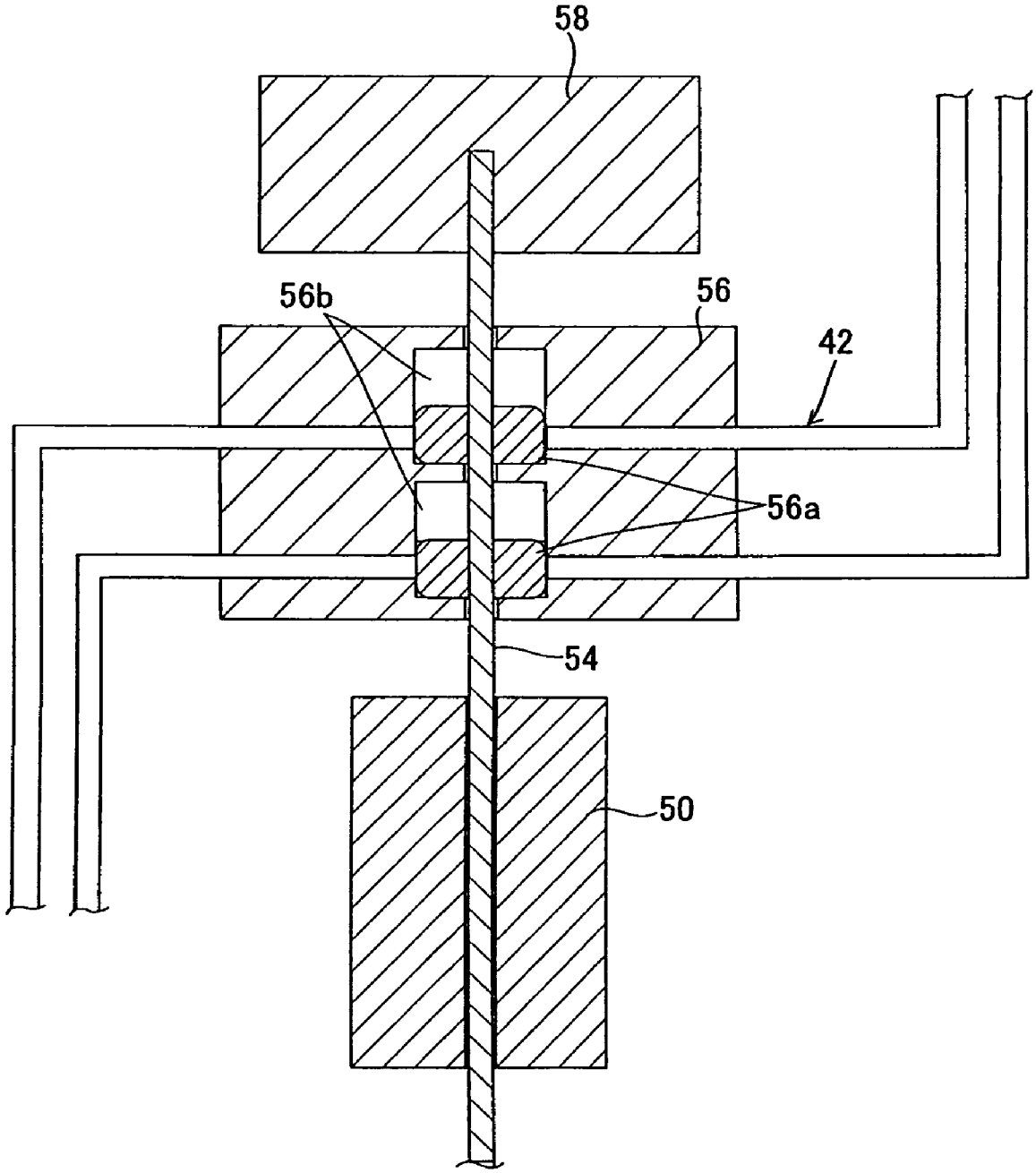
FIG. 2 is an enlarged sectional view showing a region of an oil-path opening/closing mechanism of the outboard motor steering control system shown in FIG. 1.

FIG. 2 is an enlarged sectional view showing a region of the oil-path opening/closing mechanism 56.

The oil-path opening/closing mechanism 56 comprises valve members 56*a* each provided at the oil path of the hydraulic circuit 42 and housing members 56*b* housing the valve members 56*a*.

As shown in FIGS. 1 and 2, the clutch shifter 54 penetrates the solenoid 50 and extends upward in the drawing sheet and the valve members 56*a* are attached to the extended clutch shifter 54. With this structure, the valve members 56*a* are moved up and down in the housing members 56*b* in conjunction with the clutch 52, i.e., the first dog plate 52*a*. Specifically, when the first dog plate 52*a* is driven to move upward to be engaged with the second dog plate 52*b*, each valve member 56*a* is moved upward in the housing member 56*b*, thereby making the oil path of the hydraulic circuit 42 opened or communicated. On the other hand, when the first dog plate 52*a* is driven to move downward to be engaged with the third dog plate 52*c*, each valve member 56*a* is moved downward in the housing member 56*b* to block communication of the oil path of the hydraulic circuit 42.

A recirculation circuit (not shown) composed of a check valve is provided between the oil-path opening/closing mechanism 56 and hydraulic cylinder 38 in the hydraulic circuit 42. Therefore, even when the oil path is blocked by the valve members 56*a*, the hydraulic cylinder 38 can be extended and contracted in response to external force, e.g., the force generated by the electric motor 24 of the electric steering mechanism 20.

The clutch shifter 54 penetrates the oil-path opening/closing mechanism 56 and extends upward in the drawing sheet, as shown in FIGS. 1 and 2. A manual knob 58 is attached at the extended end of the clutch shifter 54 to be freely manipulated by the operator. De-energizing the solenoid 50, i.e., manipulating the tab switch 48 to the E position by the operator enables the manual knob 58 to be freely manipulated upward and downward. Specifically, the vertical manipulation of the manual knob 58 can drive the clutch 52 also, more exactly the first dog plate 52*a*, to establish or release the connection between the rotation shaft 34 of the steering wheel and the helm pump 40.

As shown in FIG. 1, the switching mechanism 46 comprises a clutch position sensor 60 composed of, for instance, an electromagnetic proximity switch. The clutch position sensor 60 is installed near the first dog plate 52*a* and produces an output or signal indicative of a position of the clutch 52, more exactly the first dog plate 52*a*. The output of the clutch position sensor 60 is sent to the ECU 30 through a signal line 60L. The ECU 30 controls the operation of the motor 24 of the electric steering mechanism 20 based on the output of the clutch position sensor 60.

Figure 3:
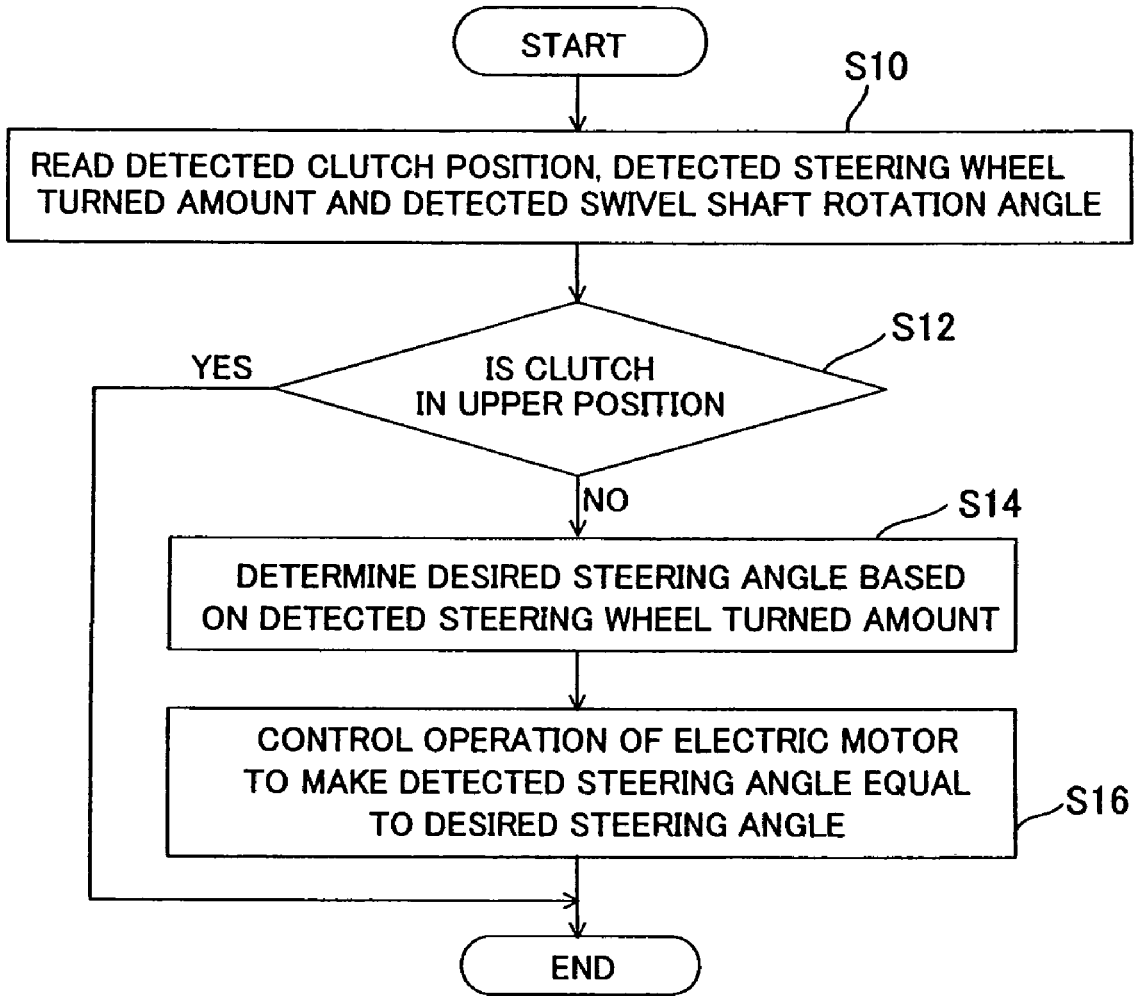
FIG. 3 is a flowchart showing the operation of switching between an electric steering mechanism and hydraulic steering mechanism conducted by an ECU in the outboard motor steering control system shown in FIG. 1.

FIG. 3 is a flowchart showing the operation. The routine of this flowchart is activated in the ECU 30 at every predetermined interval, e.g., 100 milliseconds.

The explanation will be made in the following. In S10, detected position of the clutch 52, i.e., first dog plate 52*a*, detected turned amount of the steering wheel 18 and detected rotation angle of the swivel shaft 14 are read.

The program proceeds to S12 in which it is determined whether the clutch 52 is in the upper position, more specifically the first dog plate 52*a* of the clutch 52 is in position to be engaged with the second dog plate 52*b*, i.e., in the upper position. When the result in S12 is No, specifically when it is determined that the first dog plate 52*a* is in position to be engaged with the third dog plate 52*c*, i.e., in the lower position, since this indicates that the steering mechanism has been switched to the electric steering mechanism 20, the program proceeds to S14 in which the desired steering angle of the outboard motor is determined based on the detected turned amount of the steering wheel 18.

This determination is made by multiplying the detected turned amount of the steering wheel 18 by a predetermined ratio that is obtained by dividing the maximum steering angle in the left or right of the outboard motor by the number of turns of the steering wheel 18 within lock-to-lock positions.

Then the program proceeds to S16 in which the electric motor 24 is driven to make the detected steering angle equal to the determined desired steering angle.

On the other hand, when the result in S12 is Yes, i.e., when it is determined that the first dog plate 52*a* is in the upper position, since this indicates that the steering mechanism has been switched to the hydraulic steering mechanism 22, S14 and S16 of the routine are skipped and the program is terminated.

Thus, the connection between the rotation shaft 34 of the steering wheel 18 and the helm pump 40 is established or released by the clutch 52 of the switching mechanism 46 and based on a position of the clutch 52, more exactly the first dog plate 52*a*, the ECU 30 of the electric steering mechanism 20 controls the operation of the motor 24. This structure makes it possible to achieve switching between the electric steering mechanism 20 and hydraulic steering mechanism 22 in response to manipulation by the operator.

In the outboard motor steering control system according to the first embodiment, it is configured to have both the electric steering mechanism 20 and the hydraulic steering mechanism 22 and also have the switching mechanism (switch) 46 that switches therebetween in response to manipulation by the operator. Specifically, the switching mechanism 46 is configured to include includes a driver (comprising the tab switch 48 disposed to be freely manipulated by the operator and the electromagnetic solenoid 50 which is energized/de-energized in response to manipulation of the tab switch by the operator), and the clutch 52 is configured to disconnect the helm (hydraulic) pump 40 from the hydraulic cylinder (actuator) 38 in response to manipulation of the driver by the operator such that the hydraulic steering actuator (38) becomes inoperative.

With this, switching from one of the electric steering mechanism 20 and hydraulic steering mechanism 22 to the other can be easily conducted, thereby enabling to easily cope with the operator's preference of steering feel. Further, even when a failure occurs in one of the electric steering mechanism 20 and hydraulic steering mechanism 22, the steering operation of the outboard motor can be continued by switching from the one steering mechanism to the other, i.e., normally-operating steering mechanism.

Further, since it is configured such that the switching mechanism 46 comprises the clutch 52 that establishes or releases the connection between the rotation shaft 34 of the steering wheel 18 and the helm pump 40, oil-path opening/closing mechanism 56 that opens and closes the oil path of the hydraulic circuit 42 in conjunction with the clutch 52 and the clutch position sensor 60 that detects a position of the clutch 52, i.e., the first dog plate 52*a*, and the ECU 30 controls the operation of the motor 24 based on a position of the clutch 52, it becomes possible to easily and reliably switch from one of the electric steering mechanism 20 and hydraulic steering mechanism 22 to the other with simple structure.

Furthermore, it is configured such that the clutch 52 is driven by one of the electromagnetic solenoid 50 and manual knob 58, thereby enhancing flexibility in design of the switching mechanism 46.

Further, it is configured such that the motor 24 rotates the swivel shaft 14 through the gear mechanism 44 to steer the outboard motor 10 relative to the boat 12, thereby enabling to make the electric steering mechanism 20 simple in its structure.

Next, an outboard motor steering control system according to a second embodiment will be explained.

Figure 4:
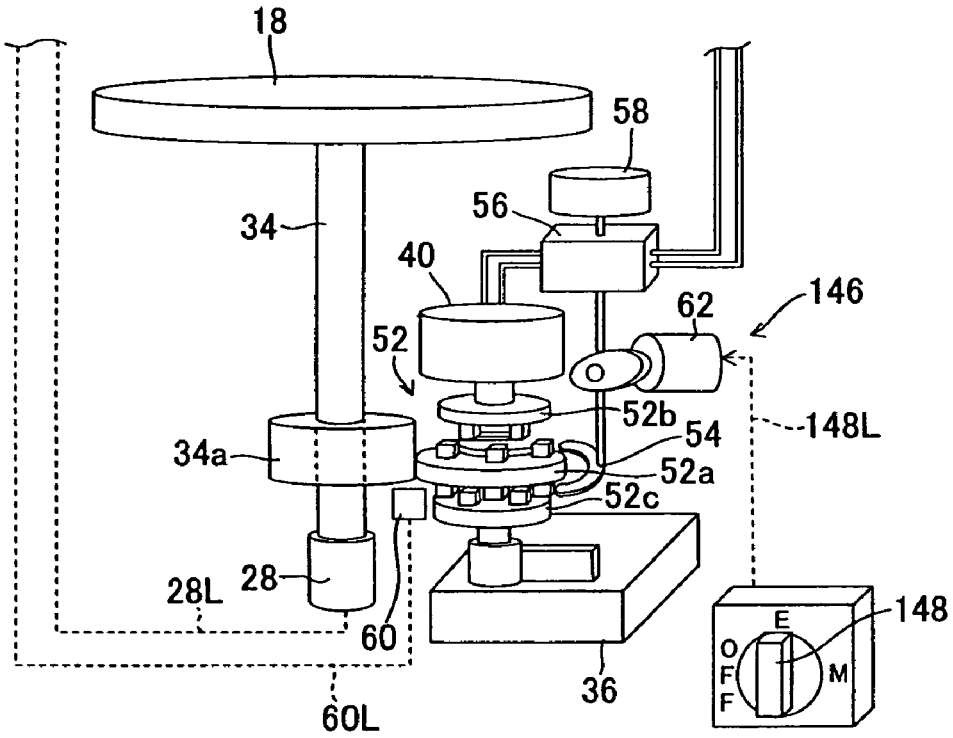
FIG. 4 is a schematic view similar to FIG. 1 but partially showing an outboard motor steering control system according to a second embodiment of the invention.

FIG. 4 is a schematic view similar to FIG. 1 but partially showing the outboard motor steering control system according to the second embodiment. Note that constituent elements corresponding to those of the first embodiment are assigned by the same reference symbols as those in the first embodiment and will not be explained.

The explanation will be made with focus on points of difference from the first embodiment. In the second embodiment, the switching mechanism 46 is replaced by a switching mechanism (switch) 146 that is partially different from the switching mechanism. Specifically, the switching mechanism 146 is equipped with an electric motor 62 in place of the electromagnetic solenoid 50. The switching mechanism 146 having this electric motor 62 will be explained below.

In addition to this electric motor 62, the switching mechanism 146 has a tab switch 148 and clutch 52.

The tab switch 148 is connected to the electric motor 62 through a signal line 148L. The tab switch 148 has three positions, i.e., an E position for energizing the electric motor 62 to rotate clockwise, an M position for energizing it to rotate counterclockwise and an OFF position for de-energizing it, and is manipulated by the operator to conduct switching among the three positions.

The first dog plate 52*a* of the clutch 52 is connected via the clutch shifter 54 to the output shaft of the electric motor 62. When the tab switch 148 is manipulated to the M position by the operator, the electric motor 62 drives through the clutch shifter 54 the first dog plate 52*a* to move upward, thereby establishing engagement of the first dog plate 52*a* with the second dog plate 52*b*. On the other hand, when the tab switch 148 is manipulated to the E position by the operator, the electric motor 62 drives through the clutch shifter 54 the first dog plate 52*a* to move downward, thereby establishing engagement of the first dog plate 52*a* with the third dog plate 52*c*. When the tab switch 148 is manipulated to the OFF position by the operator, the aforementioned manual knob 58 can be freely manipulated up and down.

In the second embodiment, similarly to the first embodiment, the clutch 52 is driven by the manual knob 58. The remaining configuration including the electric steering mechanism 20 and hydraulic steering mechanism 22 is also the same as that in the first embodiment.

Since the outboard motor steering control system according to the second embodiment is thus configured to drive the clutch 52 using the switching mechanism 146 equipped with the electric motor 62, it can provide the same effects as those explained regarding the first embodiment.

Next, an outboard motor steering control system according to a third embodiment will be explained.

Figure 5:
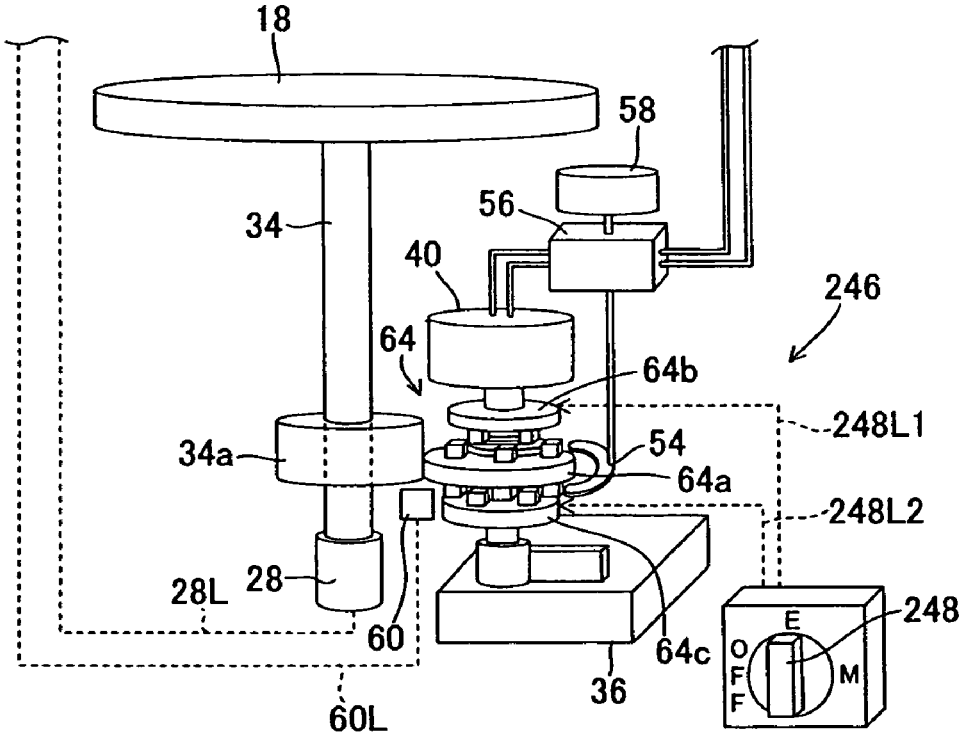
FIG. 5 is a schematic view similar to FIG. 1 but partially showing an outboard motor steering control system according to a third embodiment of the invention.

FIG. 5 is a schematic view similar to FIG. 1 but partially showing the outboard motor steering control system according to the third embodiment. Also, constituent elements corresponding to those of the first embodiment are assigned by the same reference symbols as those in the first embodiment and will not be explained.

The explanation will be made with focus on points of difference from the first embodiment. In the third embodiment, the switching mechanism 46 is replaced by a switching mechanism (switch) 246 that is partially different therefrom. Specifically, the switching mechanism 246 is equipped with an electromagnetic clutch 64 in place of the electromagnetic solenoid 50 and clutch 52. The switching mechanism 246 having the electromagnetic clutch 64 will be explained below.

The switching mechanism 246 comprises a tab switch 248 and the electromagnetic clutch 64.

As shown in FIG. 5, the electromagnetic clutch 64 is composed of three electromagnetic dog plates accumulated one above the other. A first electromagnetic dog plate 64*a* located middle among three, second electromagnetic dog plate 64*b* located thereabove and third electromagnetic dog plate 64*c* located therebelow are the same in shape as the first, second and third dog plates 52*a*, 52*b* and 52*c* of the clutch 52 in the first embodiment. The clutch 64 is, however, different from the clutch 52 in the first embodiment in that the second and third electromagnetic dog plates 64*b* and 64*c* are energized to generate magnetic suction power, thereby driving the first electromagnetic dog plate 64*a* up and down.

The second and third electromagnetic dog plates 64*b* and 64*c* are connected to the tab switch 248 through signal lines 248L1 and 248L2, respectively. The tab switch 248 has three positions, i.e., an E position for de-energizing the second electromagnetic dog plate 64*b*, while energizing the third electromagnetic dog plate 64*c*, an M position for energizing the second electromagnetic dog plate 64*b*, while de-energizing the third electromagnetic dog plate 64*c*, and an OFF position for de-energizing both the second and third electromagnetic dog plates 64*b*, 64*c*, and is manipulated by the operator to conduct switching among the three positions.

When the tab switch 248 is manipulated to the M position by the operator, magnetic attraction is generated in the second electromagnetic dog plate 64*b* to move the first electromagnetic dog plate 64*a* upward, thereby establishing engagement of the first electromagnetic dog plate 64*a* with the second electromagnetic dog plate 64*b*. When the tab switch 248 is manipulated to the E position, the generated magnetic attraction in the third electromagnetic dog plate 64 moves the first electromagnetic dog plate 64*a* downward, thereby establishing engagement of the first electromagnetic dog plate 64*a* with the third electromagnetic dog plate 64*c*. When the tab switch 248 is manipulated to the OFF position by the operator, the aforementioned manual knob 58 can be freely manipulated up and down.

In the third embodiment, similarly to the first embodiment, the electromagnetic clutch 64 is driven by the manual knob 58. The remaining configuration including the electric steering mechanism 20 and hydraulic steering mechanism 22 is also the same as that in the first embodiment.

Since the outboard motor steering control system according to the third embodiment is thus configured such that the clutch of the switching mechanism 246 comprises the electromagnetic clutch 64, it can provide the same effects as those explained regarding the first embodiment. Further, the electromagnetic clutch 64 is operated directly in response to a position of the tab switch 248, thereby enabling to make the switching mechanism 246 still simpler in structure than the switching mechanism 46 in the first embodiment.

Next, an outboard motor steering control system according to a fourth embodiment will be explained.

The explanation will be made with focus on points of difference from the first embodiment. In the fourth embodiment, the ECU 30 is connected to the electromagnetic solenoid 50 through a signal line 50L, as indicated by a phantom line in FIG. 1, such that the ECU 30 can conduct switching between the electric steering mechanism 20 and hydraulic steering mechanism 22 in addition to the switching operation by the operator.

Figure 6:
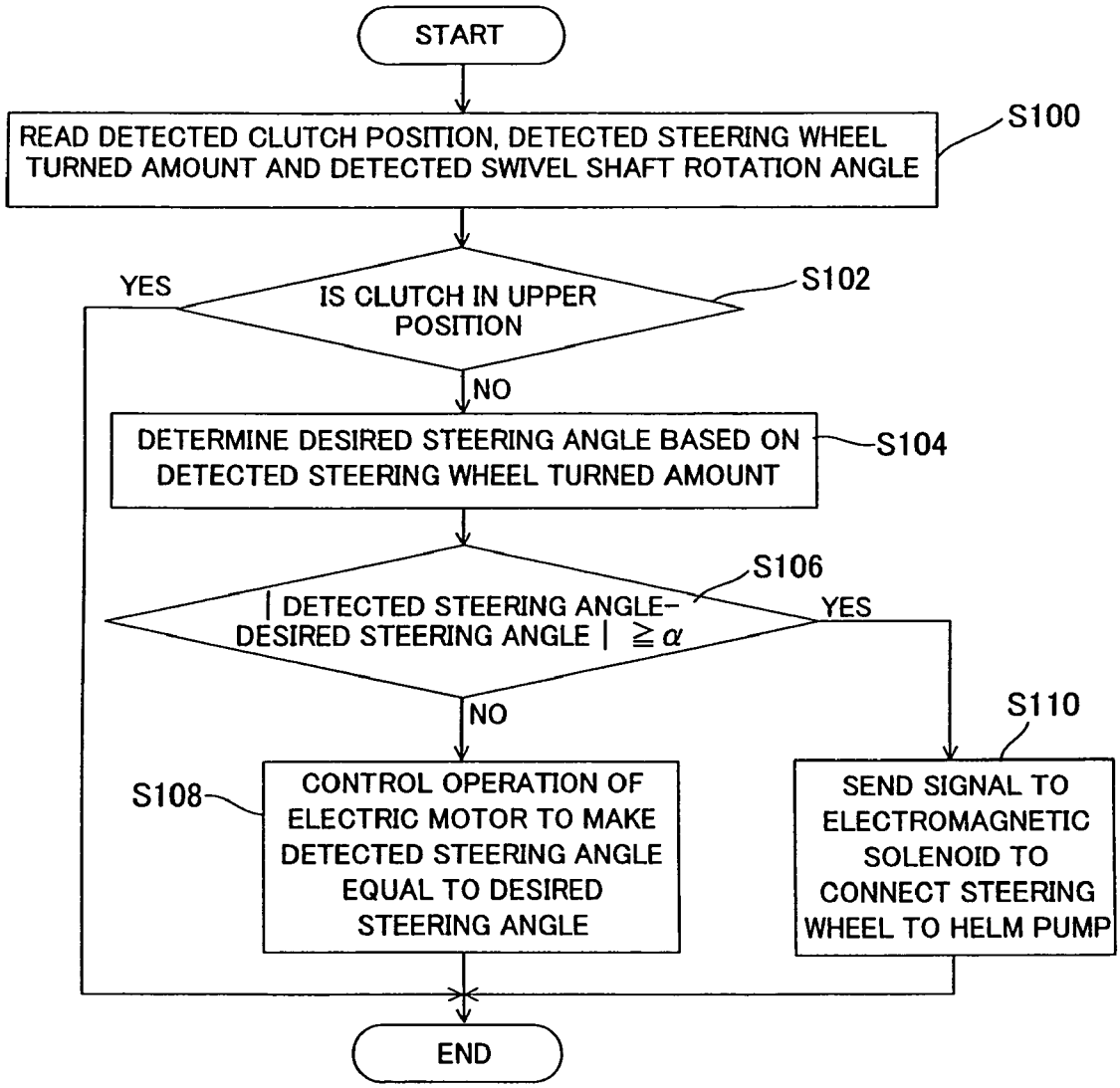
FIG. 6 is a flowchart showing the operation of switching between an electric steering mechanism and a hydraulic steering mechanism conducted by an ECU in an outboard motor steering control system according to a fourth embodiment of the invention.

FIG. 6 is a flowchart similar to FIG. 3 showing the operation.

The program is executed similarly to S10 to S14. Specifically, the program starts in S100 in which detected position of the clutch 52, i.e., first dog plate 52*a*, detected turned amount of the steering wheel 18 and detected rotation angle of the swivel shaft 14 are read and proceeds to S102 in which it is determined whether the first dog plate 52*a* is in the upper position. When the result in S102 is No, it is determined that the steering mechanism has been switched to the electric steering mechanism 20, the program proceeds to S104 in which the desired steering angle is determined base on the detected turned amount of the steering wheel 18 and then proceeds to S106.

In S106, it is determined whether an error between the detected steering angle of the swivel shaft 14 and determined desired steering angle is equal to or greater than a predetermined value $\alpha$ (e.g., 5 degrees) in absolute value. When the result in S106 is No, it is determined that the operation of the electric steering mechanism 20 is normal and the program proceeds to S108.

In S108, similarly to S16, the electric motor 24 is driven to make the detected steering angle equal to the determined desired steering angle. On the other hand, when the result in S106 is Yes, it is determined that a failure has occurred in the electric steering mechanism 20 and the program proceeds to S110.

In S110, the electromagnetic solenoid 50 is sent, via the signal line 50L, with a signal for driving the first dog plate 52*a* upward, such that the rotation shaft 34 of the steering wheel 18 is connected to the helm pump 40. In the next routine onward, unless the clutch 52 is manipulated by the operator, the result in S102 is to be Yes and it is switched from the electric steering mechanism 20 to the hydraulic steering mechanism 22.

The remaining configuration including the electric steering mechanism 20, hydraulic steering mechanism 22 and switching mechanism 46 is the same as those in the first embodiment.

Since the outboard motor steering control system according to the fourth embodiment is thus configured to have both the electric steering mechanism 20 and hydraulic steering mechanism 22 and configured such that the ECU 30 conducts switching between the electric steering mechanism 20 and hydraulic steering mechanism 22, when a failure occurs in the electric steering mechanism 20, it is possible to immediately switch to the hydraulic steering mechanism 22, thereby enabling to continue the steering operation of the outboard motor.

An outboard motor steering control system according to a fifth embodiment of the invention will now be explained.

Figure 7:
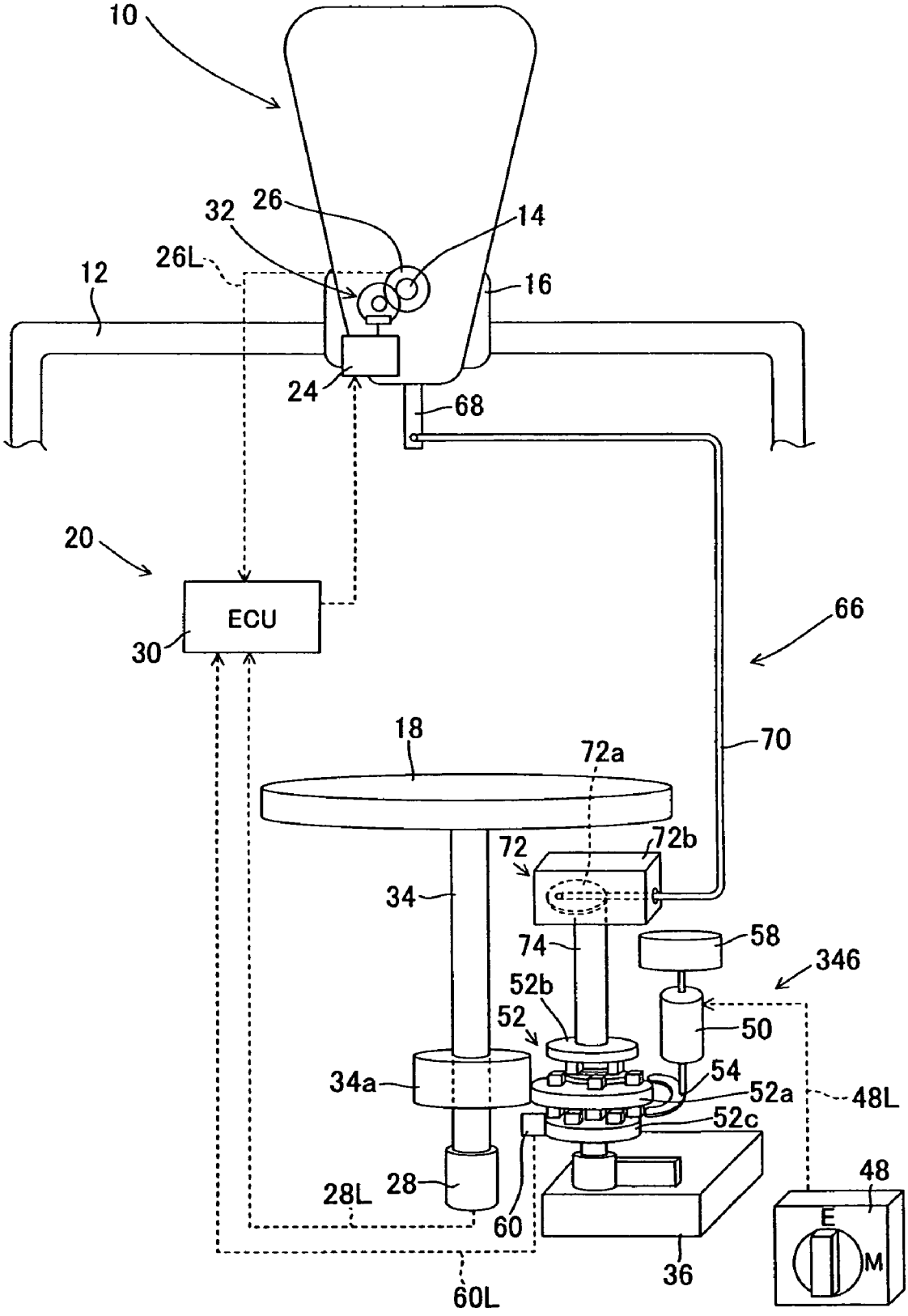
FIG. 7 is a schematic view similar to FIG. 1 but showing an outboard motor steering control system according to a fifth embodiment of the invention.

FIG. 7 is a schematic view similar to FIG. 1 showing the outboard motor steering control system according to the fifth embodiment. Also, constituent elements corresponding to those of the first embodiment are assigned by the same reference symbols as those in the first embodiment and will not be explained.

The explanation will be made with focus on points of difference from the first embodiment. In the fifth embodiment, the hydraulic steering mechanism 22 is replaced by a manual steering mechanism 66. Along with the change to the manual steering mechanism 66, instead of the switching mechanism 46, a switching mechanism (switch) 346 that is partially different from the mechanism 46 is provided.

Specifically, as shown in FIG. 7, it is configured such that the manual steering mechanism 66 is installed, and the hydraulic cylinder 38, helm pump 40, hydraulic circuit 42 and link mechanism 44 are removed. More specifically, the switching mechanism 346 is like the switching mechanism 46, but the oil-path opening/closing mechanism 56 is removed therefrom. The manual steering mechanism 66 will be explained below.

The manual steering mechanism 66 comprises a stay 68 installed in the outboard motor, a push-pull cable 70 connected to the stay 68 and a driving mechanism 72 that drives the push-pull cable 70 in response to turning of the steering wheel 18.

As shown in FIG. 7, the driving mechanism 72 is composed of a member 72*a* having elliptical-plate shape and a housing member 72*b* housing the member 72*a*. The member 72*a* is connected at one end with a rotation shaft 74 that is connected to the second dog plate 52*b* of the clutch 52 to rotate integrally therewith, and is connected at the other end with one end of the push-pull cable 70. The other end of the push-pull cable is connected to the stay 68 through a hole formed in the housing member 72*b*.

In the switching mechanism 346, similarly to the first embodiment, the clutch 52, more exactly the first dog plate 52*a* is driven by the electromagnetic solenoid or manual knob 58. When the first dog plate 52*a* is driven to move upward to be engaged with the second dog plate 52*b*, turning of the steering wheel 18 is transferred through the rotation shaft 74, driving mechanism 72 and push-pull cable 70 to the stay 68 to move it. The movement of the stay 68 makes the swivel shaft 14 rotate, thereby steering the outboard motor 10 relative to the boat 12. The remaining configuration including the electric steering mechanism 20 and the like is the same as that in the first embodiment.

Since the outboard motor steering control system according to the fifth embodiment is thus configured to have both the electric steering mechanism 20 and manual steering mechanism 66 and further have the switching mechanism 346 to conduct switching therebetween in response to manipulation by the operator, switching from one of the electric steering mechanism 20 and manual steering mechanism 66 to the other can be easily conducted, thereby enabling to easily cope with the operator's preference of steering feel. Further, even when a failure occurs in one of the electric steering mechanism 20 and manual steering mechanism 66, the steering operation of the outboard motor can be continued by switching from the one steering mechanism to the other, i.e., normally-operating steering mechanism.

Next, an outboard motor steering control system according to a sixth embodiment will be explained.

Figure 8:
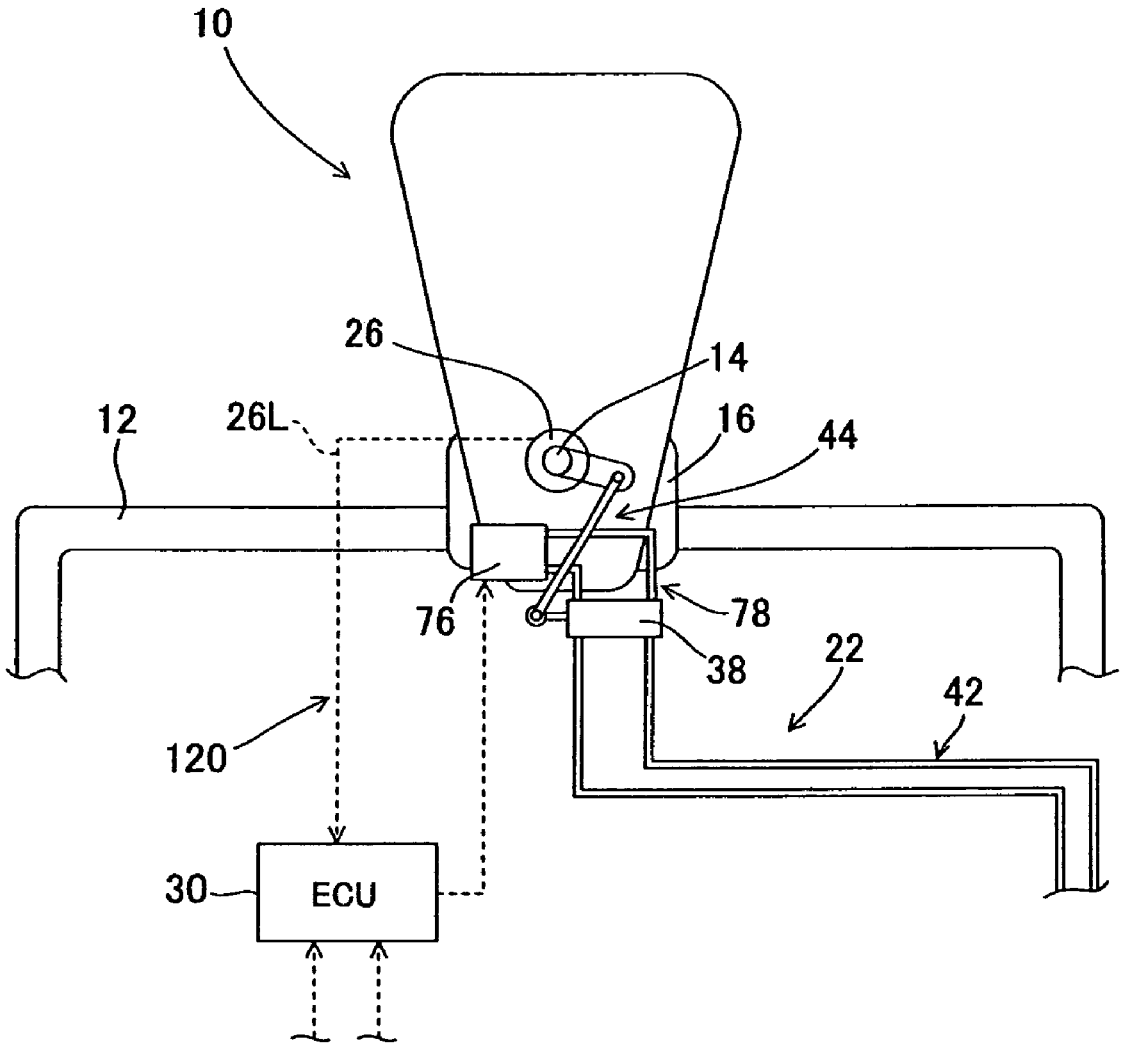
FIG. 8 is a schematic view similar to FIG. 1 but partially showing an outboard motor steering control system according to a sixth embodiment of the invention.

FIG. 8 is a schematic view similar to FIG. 1 but partially showing the outboard motor steering control system according to the sixth embodiment. Similarly, constituent elements corresponding to those of the first embodiment are assigned by the same reference symbols as those in the first embodiment and will not be explained.

The explanation will be made with focus on points of difference from the first embodiment. In the sixth embodiment, the electric steering mechanism 20 is replaced by an electric steering mechanism 120 that is partially different the mechanism 20. Specifically, an electrically-operated hydraulic pump 76 is provided in place of the electric motor 24 and gear mechanism 32 of the electric steering mechanism 20. The electric steering mechanism 120 equipped with the electrically-operated hydraulic pump 76 will be explained below.

In the electric steering mechanism 120, the hydraulic pump 76 is connected to the hydraulic cylinder 38 through the hydraulic circuit 78. Specifically, the electric steering mechanism 120 uses the hydraulic pump 76 to drive the hydraulic cylinder 38 of the hydraulic steering mechanism 22, thereby rotating the swivel shaft 14 through the link mechanism 44 to steer the outboard motor 10 relative to the boat 12.

The remaining configuration including the electric steering mechanism 20, switching mechanism 46 and the like is the same as those in the first embodiment.

Since the outboard motor steering control system according to the sixth embodiment is thus configured to have both the electric steering mechanism 120 and hydraulic steering mechanism 22 and further have the switching mechanism 46 to conduct switching therebetween in response to manipulation by the operator, it can provide the same effects as that explained regarding the first embodiment. In addition, since it is configured such that the electrically-operated hydraulic pump 76 of the electric steering mechanism 120 is operated to steer the outboard motor 10 through the hydraulic cylinder 38 of the hydraulic steering mechanism 22, i.e., the hydraulic cylinder 38 is used in common, even though the outboard motor steering mechanism is equipped with both the electric steering mechanism 120 and hydraulic steering mechanism 22, the number of components can be decreased.

The present exemplary embodiments are thus configured to have a system for controlling steering of an outboard motor (10) adapted to be mounted on a stem of a boat (12) and having an internal combustion engine that powers a propeller, comprising: a steering wheel (18) adapted to be installed at a cockpit of the boat to be turned by an operator; a steering shaft (swivel shaft 14) installed in the outboard motor through which the outboard motor can be steered relative to the boat; an electric steering mechanism (20) having a steering wheel angle sensor (28) which produces an output indicative of a turned amount of the steering wheel, a rotation angle sensor (26) which produces an output indicative of a rotation angle of the steering shaft, an electric actuator (electric motor 24) which is adapted to rotate the outboard motor about the steering shaft, and a controller (ECU 30) which controls operation of the electric actuator in response to the outputs of the steering wheel angle sensor and the rotation angle sensor such that the outboard motor is steered relative to the boat; a hydraulic steering mechanism (22) having a hydraulic actuator (hydraulic cylinder 38) which is adapted to rotate the outboard motor about the steering shaft and a hydraulic pump (helm pump 40) which supplies operating oil to the hydraulic actuator in response to turning of the steering wheel such that the outboard motor is steered relative to the boat; and a switch (switching mechanism 46, 146, 246) which switches the mechanism between the electric steering mechanism and the hydraulic steering mechanism in response to manipulation by an operator.

In the system, the switch includes: a driver (electromagnetic solenoid 50; electric motor 62, tab switch 48, manual knob 58) disposed to be freely manipulated by the operator; and a clutch (52, electromagnetic clutch 64) which disconnects the hydraulic pump from the hydraulic actuator in response to manipulation of the driver by the operator such that the hydraulic steering mechanism becomes inoperative.

In the system, the driver includes; a tab switch (48) disposed to be freely manipulated by the operator; and an electromagnetic solenoid (50) which is energized/de-energized in response to manipulation of the tab switch by the operator; and the clutch disconnects the hydraulic pump from the hydraulic actuator in response to the manipulation of the tab switch.

In the system, the driver includes; a manual knob (58) disposed to be freely manipulated by the operator; and the clutch (52) disconnects the hydraulic pump from the hydraulic actuator in response to the manipulation of the manual knob.

The system further includes: an oil-path opening/closing mechanism (56) which closes an oil path (in a hydraulic circuit 42) connecting the hydraulic pump and the hydraulic actuator when the clutch disconnects the hydraulic pump from the hydraulic actuator.

In the system, the driver includes; a tab switch (148) disposed to be freely manipulated by the operator; and an electric motor (62) which is rotated in response to manipulation of the tab switch by the operator; and the clutch (52) disconnects the hydraulic pump from the hydraulic actuator in response to the manipulation of the tab switch.

In the system, the driver includes; a tab switch (248) disposed to be freely manipulated by the operator; and the clutch (electromagnetic clutch 64) disconnects the hydraulic pump from the hydraulic actuator in response to the manipulation of the tab switch.

The system further includes: a clutch position sensor (60) which produces an output indicative of a position of the clutch; and the controller (ECU 30) determines whether the hydraulic actuator is in operation based on the output of the clutch position sensor (S10, S12, S100, S102).

The present exemplary embodiments are thus configured to have a system for controlling steering of an outboard motor (10) adapted to be mounted on a stem of a boat (12) and having an internal combustion engine that powers a propeller, comprising: a steering wheel (18) installed at a cockpit of the boat to be turned by an operator; a steering shaft (swivel shaft 14) installed in the outboard motor through which the outboard motor can be steered relative to the boat; an electric steering mechanism (20) having a steering wheel angle sensor (28) which produces an output indicative of a turned amount of the steering wheel, a rotation angle sensor (26) which produces an output indicative of a rotation angle of the steering shaft, an electric actuator (electric motor 24) which is adapted to rotate the outboard motor about the steering shaft, and a controller (ECU 30) which determines a desired steering angle based on the output of the steering wheel angle sensor and controls operation of the electric actuator to steer the outboard motor relative to the boat such that a detected steering angle detected from the output of the rotation angle sensor becomes equal to the desired steering angle (S10 to S16, S100 to S110); a hydraulic steering mechanism (22) having a hydraulic actuator (hydraulic cylinder 38) which is adapted to rotate the outboard motor about the steering shaft and a hydraulic pump (helm pump 40) which supplies operating oil to the hydraulic actuator in response to turning of the steering wheel such that the outboard motor is steered relative to the boat; and a switch (switching mechanism 46, 146, 246) which switches the mechanism between the electric steering mechanism and the hydraulic steering mechanism in response to manipulation by an operator.

In the system, the controller (ECU 30) determines whether an error between the detected steering angle and the desired angle is equal to or greater than a predetermined value ($\alpha$) (S104, S106), and operates the switch in response to the determination (S108, S110).

In the system, the controller (ECU 30) determines that a failure has occurred in the electric steering mechanism when the error is equal to or greater than the predetermined value S106), and operates the switch to switch the mechanism from the electric steering mechanism to the hydraulic steering mechanism (S110).

The present exemplary embodiments are thus configured to have a system for controlling steering of an outboard motor (10) adapted to be mounted on a stem of a boat (12) and having an internal combustion engine that powers a propeller, comprising: a steering wheel (18) adapted to be installed at a cockpit of the boat to be turned by an operator; a steering shaft (swivel shaft 14) installed in the outboard motor through which the outboard motor can be steered relative to the boat; an electric steering mechanism (20) having a steering wheel angle sensor (28) which produces an output indicative of a turned amount of the steering wheel, a rotation angle sensor (26) which produces an output indicative of a rotation angle of the steering shaft, an electric actuator (electric motor 24) which is adapted to rotate the outboard motor about the steering shaft, and a controller (ECU 30) which controls operation of the electric actuator in response to the outputs of the steering wheel angle sensor and the rotation angle sensor such that the outboard motor is steered relative to the boat; a manual steering mechanism (66) which rotates the outboard motor about the steering shaft through a cable (70) in response to turning of the steering wheel such that the outboard motor is steered relative to the boat; and a switch (switching mechanism 346) which switches steering control between the electric steering mechanism and the manual steering mechanism in response to manipulation by an operator.

In the system, the switch includes: a driver (electromagnetic solenoid 50, manual knob 58) disposed to be freely manipulated by the operator; and a clutch (52) which connects the steering wheel to the cable in response to manipulation of the driver by the operator such that the manual steering mechanism becomes operative.

In the system, the manual steering mechanism comprises a stay (68) installed in the outboard motor and connected to the cable (70) and a driving mechanism (72) which drives the cable in response to turning of the steering wheel, and the clutch connects the steering wheel to the cable through the driving mechanism.

It should be noted in the above that the first to sixth embodiments are only examples and a combination of several embodiments from among the six embodiments, e.g., a combination of the second and sixth embodiments, can be also applied as another example.

It should be also noted in the above that, although the clutch 52 or electromagnetic clutch 64 is configured to be dog type, a clutch of friction-plate type can instead be used.

It should be further noted in the above that, although only one outboard motor 10 is mounted on the boat 12, two or more outboard motors 10 can be mounted on the boat 12.

While the invention has thus been shown and described with reference to specific exemplary embodiments, it should be noted that the invention is in no way limited to the details of the described arrangements; changes and modifications may be made without departing from the scope of the appended claims.

What is claimed is:

1. A system for controlling steering of an outboard motor adapted to be mounted on a stern of a boat and having an internal combustion engine that powers a propeller, comprising:

a steering wheel adapted to be installed at a cockpit of the boat to be turned by an operator;

a steering shaft installed in the outboard motor through which the outboard motor can be steered relative to the boat;

an electric steering mechanism having a steering wheel angle sensor which produces an output indicative of a turned amount of the steering wheel, a rotation angle sensor which produces an output indicative of a rotation angle of the steering shaft, an electric actuator which is adapted to rotate the outboard motor about the steering shaft, and a controller which controls operation of the electric actuator in response to the outputs of the steering wheel angle sensor and the rotation angle sensor such that the outboard motor is steered relative to the boat;

a hydraulic steering mechanism having a hydraulic actuator which is adapted to rotate the outboard motor about the steering shaft and a hydraulic pump which supplies operating oil to the hydraulic actuator in response to turning of the steering wheel such that the outboard motor is steered relative to the boat; and a switch which switches steering control between the electric steering mechanism and the hydraulic steering mechanism in response to manipulation by an operator, wherein the switch includes:

a driver disposed to be freely manipulated by the operator; and a clutch which disconnects the hydraulic pump from the hydraulic actuator in response to manipulation of the driver by the operator, such that the hydraulic steering mechanism becomes inoperative.

2. The system according to claim 1, wherein the driver includes:

a tab switch disposed to be freely manipulated by the operator; and an electromagnetic solenoid which is energized/de-energized in response to manipulation of the tab switch by the operator;

and the clutch disconnects the hydraulic pump from the hydraulic actuator in response to the manipulation of the tab switch.

3. The system according to claim 2, wherein the driver includes:

a manual knob disposed to be freely manipulated by the operator;

and the clutch disconnects the hydraulic pump from the hydraulic actuator in response to the manipulation of the manual knob.

4. The system according to clam 2, further including:

an oil-path opening/closing mechanism which closes an oil path connecting the hydraulic pump and the hydraulic actuator when the clutch disconnects the hydraulic pump from the hydraulic actuator.

5. The system according to claim 1, wherein the driver includes:

a tab switch disposed to be freely manipulated by the operator; and an electric motor which is rotated in response to manipulation of the tab switch by the operator;

and the clutch disconnects the hydraulic pump from the hydraulic actuator in response to the manipulation of the tab switch.

6. The system according to claim 5, wherein the driver includes:

a manual knob disposed to be freely manipulated by the operator;

and the clutch disconnects the hydraulic pump from the hydraulic actuator in response to the manipulation of the manual knob.

7. The system according to clam 5, further including:

an oil-path opening/closing mechanism which closes an oil path connecting the hydraulic pump and the hydraulic actuator when the clutch disconnects the hydraulic pump from the hydraulic actuator.

8. The system according to claim 1, wherein the driver includes:

a tab switch disposed to be freely manipulated by the operator;

and the clutch disconnects the hydraulic pump from the hydraulic actuator in response to the manipulation of the tab switch.

9. The system according to claim 8, wherein the driver includes:

a manual knob disposed to be freely manipulated by the operator;

and the clutch disconnects the hydraulic pump from the hydraulic actuator in response to the manipulation of the manual knob.

10. The system according to clam 8, further including:

an oil-path opening/closing mechanism which closes an oil path connecting the hydraulic pump and the hydraulic actuator when the clutch disconnects the hydraulic pump from the hydraulic actuator.

11. The system according to claim 1, further including:

a clutch position sensor which produces an output indicative of a position of the clutch;

and the controller determines whether the hydraulic actuator is in operation based on the output of the clutch position sensor.

12. The system according to claim 1, wherein the electric actuator comprises an electric motor which rotates the steering shaft through a gear mechanism.

13. The system according to claim 1, wherein the electric actuator comprises an electrically-operated hydraulic pump which rotates the steering shaft through the hydraulic actuator of the hydraulic steering mechanism.

14. A system for controlling steering of an outboard motor adapted to be mounted on a stern of a boat and having an internal combustion engine that powers a propeller, comprising:

a steering wheel adapted to be installed at a cockpit of the boat to be turned by an operator;

a steering shaft installed in the outboard motor through which the outboard motor can be steered relative to the boat;

an electric steering mechanism having a steering wheel angle sensor which produces an output indicative of a turned amount of the steering wheel, a rotation angle sensor which produces an output indicative of a rotation angle of the steering shaft, an electric actuator which is adapted to rotate the outboard motor about the steering shaft, and a controller which determines a desired steering angle based on the output of the steering wheel angle sensor and controls operation of the electric actuator to steer the outboard motor relative to the boat such that a detected steering angle detected from the output of the rotation angle sensor becomes equal to the desired steering angle;

a hydraulic steering mechanism having a hydraulic actuator which is adapted to rotate the outboard motor about the steering shaft and a hydraulic pump which supplies operating oil to the hydraulic actuator in response to turning of the steering wheel such that the outboard motor is steered relative to the boat; and a switch which switches steering control between the electric steering mechanism and the hydraulic steering mechanism;

wherein the controller determines whether an error between the detected steering angle and the desired angle is equal to or greater than a predetermined value, and operates the switch in response to the determination.

15. The system according to claim 14, wherein the controller determines that a failure has occurred in the electric steering mechanism when the error is equal to or greater than the predetermined value, and operates the switch to switch the mechanism from the electric steering mechanism to the hydraulic steering mechanism.

16. The system according to claim 14, wherein the electric actuator comprises an electric motor which rotates the steering shaft through a gear mechanism.

17. The system according to claim 14, wherein the electric actuator comprises an electrically-operated hydraulic pump which rotates the steering shaft through the hydraulic actuator of the hydraulic steering mechanism.

18. A system for controlling steering of an outboard motor adapted to be mounted on a stern of a boat and having an internal combustion engine that powers a propeller, comprising:

a steering wheel adapted to be installed at a cockpit of the boat to be turned by an operator;

a steering shaft installed in the outboard motor through which the outboard motor can be steered relative to the boat;

an electric steering mechanism having a steering wheel angle sensor which produces an output indicative of a turned amount of the steering wheel, a rotation angle sensor which produces an output indicative of a rotation angle of the steering shaft, an electric actuator which is adapted to rotate the outboard motor about the steering shaft, and a controller which controls operation of the electric actuator in response to the outputs of the steering wheel angle sensor and the rotation angle sensor such that the outboard motor is steered relative to the boat;

a manual steering mechanism which rotates the outboard motor about the steering shaft through a cable in response to turning of the steering wheel such that the outboard motor is steered relative to the boat; and a switch which switches steering control between the electric steering mechanism and the manual steering mechanism in response to manipulation by an operator, wherein the switch includes:

a driver disposed to be freely manipulated by the operator; and a clutch which connects the steering wheel to the cable in response to manipulation of the driver by the operator, such that the manual steering mechanism becomes operative.

19. The system according to claim 18, wherein the manual steering mechanism comprises a stay installed in the outboard motor and connected to the cable and a driving mechanism which drives the cable in response to turning of the steering wheel, and the clutch connects the steering wheel to the cable through the driving mechanism.

20. The system according to claim 18, wherein the electric actuator comprises an electric motor which rotates the steering shaft through a gear mechanism.

21. The system according to claim 18, wherein the electric actuator comprises an electrically-operated hydraulic pump which rotates the steering shaft through the a hydraulic actuator of the hydraulic steering mechanism.

* * * * *